US007973459B2

(12) United States Patent
Tinwell

(10) Patent No.: US 7,973,459 B2
(45) Date of Patent: Jul. 5, 2011

(54) SPARK PLUG CONFIGURATION HAVING A NOBLE METAL TIP

(75) Inventor: Paul Tinwell, Fayence (FR)

(73) Assignee: Federal-Mogul Ignition (U.K.) Limited, Manchester (GB)

( * ) Notice: Subject to any disclaimer, the term of this patent is extended or adjusted under 35 U.S.C. 154(b) by 28 days.

(21) Appl. No.: 12/506,314

(22) Filed: Jul. 21, 2009

(65) Prior Publication Data

US 2009/0284118 A1 Nov. 19, 2009

Related U.S. Application Data

(60) Continuation of application No. 11/772,553, filed on Jul. 2, 2007, now Pat. No. 7,569,978, and a division of application No. 10/770,931, filed on Feb. 3, 2004, now abandoned.

(51) Int. Cl.
*H01T 13/20* (2006.01)

(52) U.S. Cl. ..... 313/141; 313/118

(58) Field of Classification Search ..... 313/141, 313/118, 135, 142

See application file for complete search history.

(56) References Cited

U.S. PATENT DOCUMENTS

| | | | |
|---|---|---|---|
| 2,296,033 | A | 1/1941 | Heller |
| 4,700,103 | A | 10/1987 | Yamaguchi et al. |
| 4,845,400 | A | 7/1989 | Takamura et al. |
| 5,124,612 | A | 6/1992 | Takamura et al. |
| 5,159,232 | A | 10/1992 | Sato et al. |
| 5,347,193 | A | 9/1994 | Oshima et al. |
| 5,440,198 | A | 8/1995 | Oshima et al. |
| 5,514,929 | A | 5/1996 | Kawamura |
| 5,873,338 | A | 2/1999 | Matsubara et al. |
| 5,877,584 | A | 3/1999 | Kato et al. |
| 5,929,556 | A | 7/1999 | Matsubara et al. |
| 5,990,602 | A | 11/1999 | Katoh et al. |
| 6,093,071 | A | 7/2000 | Osamura et al. |
| 6,094,000 | A | 7/2000 | Osamura et al. |
| 6,147,441 | A | 11/2000 | Osamura |
| 6,262,522 | B1 | 7/2001 | Osamura et al. |
| 6,265,816 | B1 | 7/2001 | Ito et al. |
| 6,528,929 | B1 | 3/2003 | Matsutani et al. |

(Continued)

FOREIGN PATENT DOCUMENTS

GB 479540 2/1938

(Continued)

OTHER PUBLICATIONS

Japanese Office Action for Japanese Patent Appln. No. 2006-551956, dated Jun. 22, 2010, 7 pages.

(Continued)

*Primary Examiner* — Vip Patel
(74) *Attorney, Agent, or Firm* — Reising Ethington P.C.

(57) ABSTRACT

A spark plug having a particular firing end configuration that satisfies numerous dimensional ranges for improved performance. The spark plug generally includes a shell, an insulator, and center and ground electrodes, with the electrodes each having a copper core for improved thermal conductivity and a noble metal insert for improved erosion and corrosion resistance. The noble metal insert for the center electrode is preferably in the form of a cylindrical Ir-based tip, which is received within a complimentary recess formed in the center electrode. The noble metal insert for the ground electrode is in the form of a flat Pt-based pad attached to a surface of the ground electrode. Various dimensional ranges are provided for the various components of the spark plug assembly, both individually and in combination with other dimensions.

8 Claims, 2 Drawing Sheets

U.S. PATENT DOCUMENTS

| | | | |
|---|---|---|---|
| 6,548,945 | B1 | 4/2003 | Tamura |
| 6,552,476 | B1 | 4/2003 | Hanashi et al. |
| 6,653,768 | B2 | 11/2003 | Kato et al. |
| 6,707,237 | B2 | 3/2004 | Teramura et al. |
| 7,109,646 | B2 | 9/2006 | Morita et al. |
| 7,569,978 | B2 | 8/2009 | Tinwell |
| 2003/0071552 | A1 | 4/2003 | Teramura et al. |

FOREIGN PATENT DOCUMENTS

| | | |
|---|---|---|
| JP | 09-219274 | 8/1997 |
| JP | 2000243535 | 9/2000 |
| JP | 2002-359051 | 12/2002 |
| JP | 2003-142224 | 5/2003 |
| JP | 2004006250 | 1/2004 |
| JP | 2000-243535 | 9/2009 |

OTHER PUBLICATIONS

Japanese Office Action for Japanese Patent Appln. No. 2006-551956, dated Mar. 15, 2011, 4 pages.

Petition for Prior Art Submission, submitted Feb. 2, 2011 to the Japanese Patent Office, 3 pages.

SPARK PLUG CONFIGURATION HAVING A NOBLE METAL TIP

CROSS-REFERENCE TO RELATED APPLICATIONS

This application is a continuation of U.S. Ser. No. 11/772,553, filed Jul. 2, 2007, which is a divisional of U.S. Ser. No. 10/770,931, filed Feb. 3, 2004, now abandoned. The entire contents of each of these two prior applications are hereby incorporated by reference.

TECHNICAL FIELD

This invention generally relates to spark plugs used in internal combustion engines. More specifically, this invention relates to the configuration of a spark plug that utilizes a noble metal tip attached to a center and/or a ground electrode.

BACKGROUND OF THE INVENTION

It is known in the art to prolong the life of spark plug electrodes by attaching precious or noble metal tips to their firing ends. Some of the earliest examples of this technology are seen in U.S. Pat. No. 2,296,033 issued Sep. 15, 1942 to Heller, and in British Patent Specification No. 479,540 published in 1938 to Powell et al. The Heller patent teaches the attachment of precious metal tips to ground and center electrodes formed of much less expensive materials. The precious metal tips are comprised of corrosion resistant materials, including platinum alloys such as platinum-rhodium, platinum-iridium and platinum-ruthenium. Similarly, the Powell reference discloses the use of platinum, iridium, ruthenium, osmium and alloys thereof, including iridium-rhodium, for use as firing tips for spark plug electrodes. In the time since this and other early designs, there have sprung numerous other inventions attempting to utilize the corrosion and erosion resistant properties of noble and other precious metals.

For many years, platinum was the precious metal of choice for spark plug electrode firing tips, as evidenced by the numerous patents describing its use. During recent years, however, numerous other noble metals and noble metal alloys have become more frequently utilized; one of which is iridium. Iridium can be relatively inexpensive, when compared to other comparable noble metals, and has the rather high melting point of approximately 2410° C. Though many benefits exist regarding the use of iridium, it is sometimes a challenge to work with during manufacturing, as it has a tendency to crack under mechanical pressure and deformation. In order to overcome this and other challenges, various iridium-alloys have been developed with the hope of imparting certain, desirable characteristics to the metal. An example of such an alloy is taught in U.S. Pat. No. 6,094,000 issued Jul. 25, 2000 to Osamura et al. In this reference there is disclosed an Ir—Rh alloy whose relative percentages of iridium and rhodium vary according to one of several embodiments.

In addition to the electrode tip composition, removing heat from the noble metal tips of the center and/or ground electrode has proven to be an effective approach to increasing the operational life of those tips. The combustion process produces a great amount of intense heat to which the noble metal tips are exposed. Experience has shown that intense heat, for example in excess of 1000° C., can increase oxidation, chemical corrosion or electrical erosion, which can contribute to the accelerated deterioration of the noble metal tips. It is desirable to construct the firing end components, such as the noble metal tip, center or ground electrode, insulator or shell, according to certain designs and with a certain combination of dimensions such that it reduces the aforementioned accelerated deterioration, as well as other unwanted phenomenon such as carbon fouling, etc. U.S. Pat. No. 6,147,441 and U.S. Application Publication 2003/0071552 A1 are examples of references that disclose a spark plug design utilizing noble metal inserts and a series of preferred dimensions.

Thus, it would be advantageous to provide a spark plug having an improved noble metal tip located at its firing end, preferably an iridium or iridium-alloy tip, wherein the spark plug further includes firing end components designed to extend the operational life and other performance characteristics of the spark plug.

SUMMARY OF THE INVENTION

The invention provides a spark plug that generally includes a shell, an insulator, a center electrode, at least one noble metal tip, and a ground electrode. In accordance with one aspect of the invention, the center electrode further includes a main shank portion having a lower axial end to which is attached a noble metal tip. The center electrode and noble metal tip are constructed in accordance with several dimensional limitations that constrain their size at the firing end of the spark plug. According to another aspect of this invention, the insulator is constructed such that it satisfies certain dimensional constraints related to the shell and noble metal tip. According to another aspect of this invention, the ground electrode includes a noble metal pad that forms a spark gap with the noble metal tip of the center electrode. The ground electrode and noble metal pad are constructed according to several dimensional limitations pertaining to their size, with the noble metal pad having a diameter that is greater than the diameter of the noble metal tip on the center electrode. According to another aspect of this invention, the shell is an M14 shell and is constructed using a number of dimensional limitations pertaining primarily to radial dimensions of the insulator interior bore and the center electrode. According to another aspect of this invention, the shell is an M12 shell and is constructed in accordance with dimensional limitations pertaining primarily to radial dimensions of the insulator interior bore and the center electrode.

Objects, features and advantages of this invention include, but are not limited to, providing an improved spark plug having, among other features, a noble metal tip for the center electrode and/or a noble metal pad for the ground electrode, and a combination of dimensional characteristics that promotes improved spark plug performance, such as spark plug durability, as well as manufacturability, and versatility. Furthermore, it is an object of this invention to provide specific embodiments of spark plugs having M14 and M12 shells.

BRIEF DESCRIPTION OF THE DRAWINGS

These and other objects, features and advantages of this invention will be apparent from the following detailed description of the preferred embodiments and best mode, the appended claims and the accompanying drawings, in which:

DETAILED DESCRIPTION OF THE PREFERRED EMBODIMENTS

Figure 1:
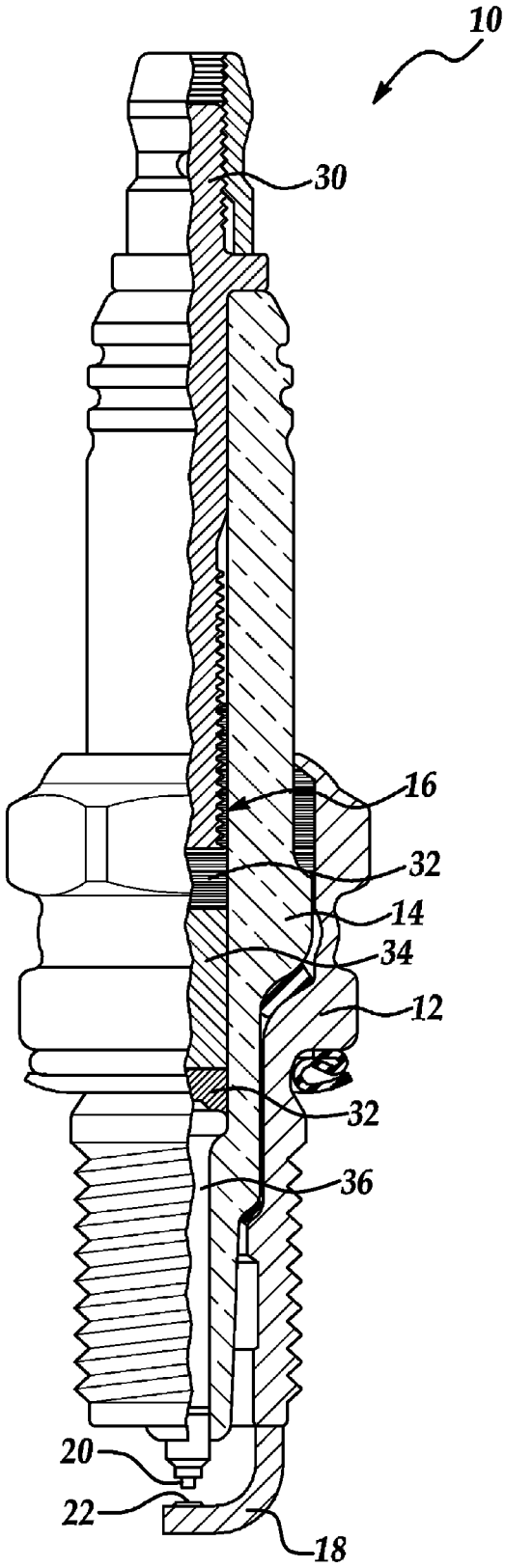
FIG. 1 shows a partial fragmentary view of a spark plug having a noble metal tip attached to a center electrode and a noble metal pad attached to a ground electrode.

With reference to FIG. 1, there is shown a spark plug assembly 10 for use in an internal combustion engine (not shown) that generally includes a shell 12, insulator 14, conductive insulator core 16, ground electrode 18, a noble metal tip 20 and a noble metal pad 22. As commonly known in the art, the shell 12 is a generally cylindrical, electrically conductive component having a hollow bore extending along its axial length. Within that bore are a series of circumferential shoulders sized to support diametrically increased sections of the insulator. Like the shell, the insulator 14 is also a generally cylindrical component with an elongated axial bore, however, as its name suggests, the insulator is made from generally non-conducting materials. The lower axial end of the insulator comprises a nose portion which extends out of and beyond the lowermost portion of the shell. The insulator axial bore is designed to receive the electrically conductive insulator core 16, which extends the entire axial length of the spark plug and generally includes a terminal electrode 30, one or more conductive and/or suppressive seals 32, a resistive component 34, and a center electrode 36. The conductive insulator core 16 shown here is simply one of numerous possible embodiments, and could easily include additional components or have components omitted. The ground electrode 18 is both mechanically and electrically connected to the lower axial end of the shell and is generally formed in an L-shape configuration. The exposed end of the center electrode 36 and a side surface of the ground electrode 18 oppose each other and are axially spaced such that they form a spark gap. On the opposed surfaces of the center and ground electrodes respectively reside noble metal tip 20 and noble metal pad 22, which provide sparking or discharge surfaces that exhibit greater resistance to electrical erosion, oxidation, and chemical corrosion than do conventional electrode materials, thereby increasing the operational life of the plug.

Figure 2:
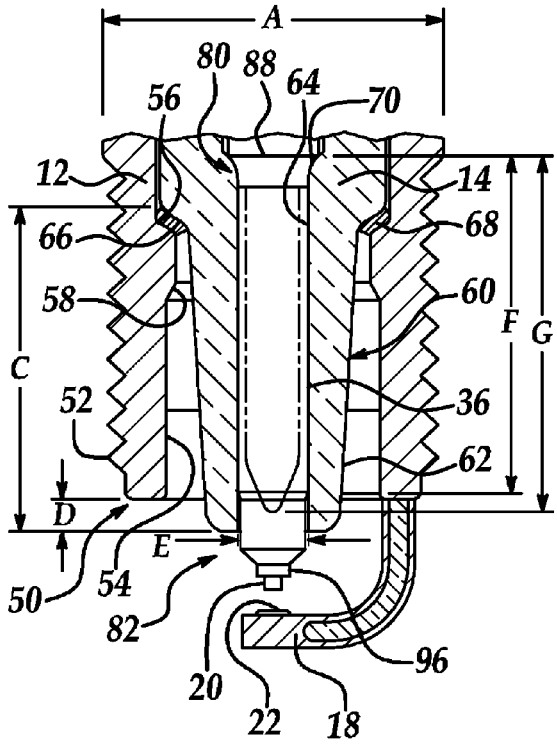
FIG. 2 shows an enlarged view of the lower axial end of the spark plug shown in FIG. 1.

FIG. 2 is an enlarged view of the lower axial end, or firing end, of the spark plug 10 shown in FIG. 1. Shell 12 can be constructed according to one of numerous designs known in the art, but is preferably made from steel and includes an open lower axial end 50 having an exterior cylindrical surface 52 and an interior axial bore 54. The lower section of exterior surface 52 is threaded such that it may be screwed into a complimentary hole in the cylinder head (not shown). The axial bore 54 includes one or more interior shoulders 56 that are formed as a result of a decrease in the diameter of the bore, and are sized to receive and support the insulator 14. The axial bore also includes one or more interior expansion portions 58 defined by an increase in the diameter of the bore. Interior expansion portion 58 creates a generally cylindrical space between the axial bore 54 of the shell and the outer surface of the insulator 14. The radial separation between the shell axial bore and the exterior surface of the insulator is non-uniform, as the insulator may have a taper towards its lower axial end. This generally cylindrical space can affect the operation of the plug, as it is capable of reducing the amount of flash over between the center electrode assembly 36 and the shell 12, and is also capable of affecting the heat transfer properties at the firing end. The distance between the outer surface of the insulator and the inner surface of the bore of shell 12 at the lower axial end or opening of the shell, is designated dimension B in FIG. 3. It is desirable that the shell 12 have the following dimensional characteristics: an outer thread diameter (A) between 10 mm-14 mm (M10-M14), and a radial separation (B) between the interior of the shell and the exterior of the insulator at a lower opening of the shell between 0 mm-3 mm. It is even more preferable that dimension (B) be between 0.75 mm-1.75 mm.

Insulator 14 can also be designed according to one of numerous constructions known in the art, but is preferably comprised of an alumina-based ceramic composition and includes an open lower axial end or nose portion 60 having an exterior surface 62 and an interior axial bore 64 that is coaxial with that of the shell. The nose portion 60 is an elongated, gradually tapering, open-ended component that protrudes out of the open axial end 50 of the shell. Exterior surface 62 includes one or more exterior shoulders 66 that are shaped to sealingly sit on the interior shoulders 56 of the shell. For purposes of increasing the strength of the seal between these two components, a circumferential gasket 68 may be used. As with the shell, the interior axial bore 64 of the insulator also includes one or more interior shoulders 70 defined by a decrease in the diameter of the bore. These interior shoulders 70 are designed to receive the components of the conductive insulator core 16, particularly the center electrode 36. It is desirable that the insulator 14 have the following dimensional characteristics: a nose portion axial length (C) between 8 mm-20 mm, a nose portion protrusion length (D) between 0 mm-6 mm, and an interior bore diameter (E) between 1.5 mm-3.5 mm. It is even more preferable that dimension (C) be between 12 mm-18 mm, that dimension (D) be between 0.5 mm-1.75 mm, and that dimension (E) be between 2 mm-3 mm. In addition to these 'desirable' and 'more preferable' dimensional ranges, which are generally applicable to spark plug shells of all sizes, there also exists a subset of dimensional ranges that are specifically correlated to spark plugs of a particular shell size. For instance, it can be desirable to provide M14 plugs (threaded outer shell diameter of 14 mm) with an insulator interior bore diameter (E) between 2.5 mm-3 mm, while providing M12 plugs with a bore diameter (E) between 2 mm-2.5 mm.

Figure 3:
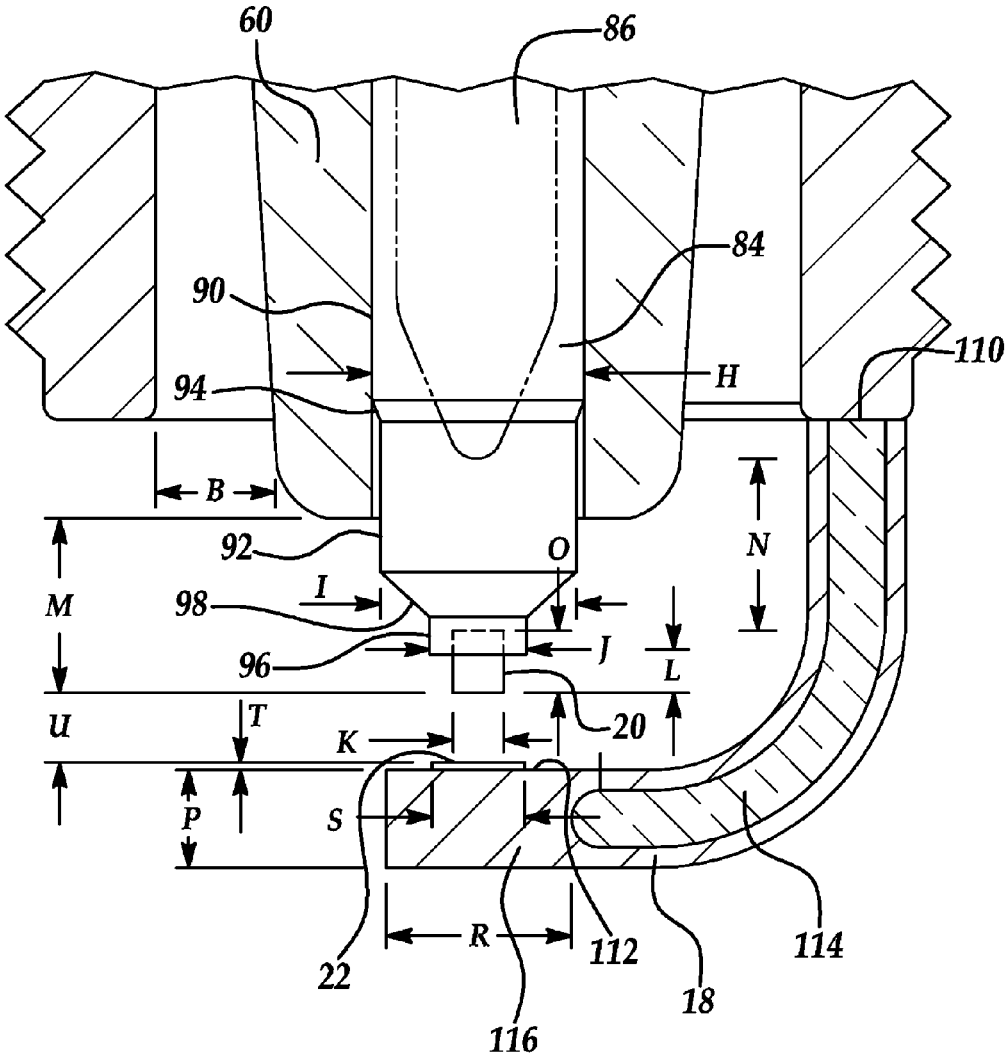
FIG. 3 shows an enlarged view of the lower axial end of the spark plug shown in FIG. 2.

The center electrode 36 is preferably an elongated, corrosion and heat resistant component that generally includes an upper axial end 80, a lower axial or firing end 82, and noble metal tip 20. Extending between the upper and lower axial ends is a cladding material 84 (shown in FIG. 3) and an elongated copper slug 86 having high thermal conductivity. An example of an appropriate material to use for the cladding material 84 is referred to as #522 alloy, which is comprised of approximately 95.5% nickel, 1.9% manganese, 1.75% chromium, 0.4% silicon, 0.3% titanium, and 0.15% zirconium, and is available from the Champion Ignition Products division of Federal-Mogul Corporation. This material displays a thermal conductivity of approximately 50 W/mK when the material is at a temperature of around 1000° C. The upper axial end 80 includes a radially enlarged head section 88 that is designed to be seated upon an interior shoulder 70 of the insulator, such that the center electrode assembly is prevented from slipping out of the insulator axial bore. The lower axial end 82 includes several radially reduced sections connected by several tapered sections. A main shank portion 90 of the center electrode, which is best seen in FIG. 3, is connected to a first radially reduced section 92 by means of a first tapered section 94. Similarly, the first radially reduced section 92 is connected to a second radially reduced section or collar section 96 by means of a second tapered section 98. As evidenced in the drawings, it is preferable that the radial contraction, that is the difference in radii, between the first and second sections 92 and 96 be greater than radial contraction between the main shank and first sections 90 and 92. This results in the second tapered section 98 being much larger and more pronounced than the slighter tapered section 94. As will be subsequently described in greater detail, it is the collar section 96 that provides the base to which the noble metal tip 20 is attached. It is desirable that the center electrode 36 have the following dimensional characteristics: a main shank length (F) between 10 mm-25 mm, a copper-core length (G) between 10 mm-25 mm, a main shank diameter (H) between 1.5 mm-3.5 mm, a first radially reduced portion diameter (I) between 1.5 mm-3.5 mm, and a collar section diameter (J) between 0.75 mm-1.75 mm. This collar section diameter may change as a result of welding or another attachment technique used to join the noble metal tip 20 to the remainder of the center electrode 36, in which case it will be understood that this dimension (J) refers to the dimension of the collar prior to such attachment. It is even more preferable that dimension (F) be between 13 mm-20 mm, that dimension (G) be between 13 mm-20 mm, that dimension (H) be between 2 mm-3 mm, the dimension (I) be between 1.75 mm-3 mm, and that dimension (J) be between 1 mm-1.5 mm. As mentioned in the preceding paragraph, in addition to these 'desirable' and 'more preferable' dimensional ranges, there also exists a subset of dimensional ranges that are specifically correlated to spark plugs of a particular shell size. In the context of M14 plugs, it is desirable to provide a center electrode having a main shank portion with a diameter (H) between 2.5 mm-3 mm, and a first radially reduced portion having a diameter (I) between 2.25 mm-3 mm. M12 plugs, on the other hand, preferably include a center electrode having a main shank portion with a diameter (H) between 2 mm-2.5 mm, and a first radially reduced portion having a diameter (I) between 1.75 mm-2.25 mm.

The noble metal tip 20 is attached to the lower axial end of the center electrode 36 for purposes of increasing the operational life of the plug, and is preferably comprised of iridium (Ir) or an iridium-alloy, such as Ir—Rh. Even more preferably, the noble metal tip is comprised of an Ir—Rh alloy, where Ir is the primary component and Rh makes up between 1-20%. Of course, the noble metal tip 20 can be comprised of other noble metals, such as Pt, Pd, Ru, or any combination thereof, as all are known in the art. According to its preferable shape, the noble metal tip is a cylindrically-shaped component that is sized such that an upper axial end fits within a blind bore or recess located in the collar section 96 of the center electrode. The depth to which the noble metal tip extends into the bore may vary, so long as it extends deep enough to allow for a sufficient bond between the two components. Other shapes, such as those having square, rectangular, elliptical, or other appropriate cross-sections may also be used. Attachment of the noble metal tip 20 to the collar section 96 of the center electrode may be accomplished according to one of several known techniques. For instance, a laser welding energy beam may be directed around the circumferential interface between the outer surface of the noble metal tip and the inner bore surface of the collar section, such that a portion of both the center electrode and the noble metal tip become molten. These molten portions then converge, intermix and solidify, thereby forming a circumferential weld seam that securely maintains the noble metal tip 20 in place. Alternatively, a joining process such as that disclosed in published European Patent Application No. EP 1 286 442 A1 published Feb. 26, 2003, or resistance welding, brazing, swaging, or other mechanical deformation, etc. may also be used. It is desirable that the noble metal tip 20 be a cylindrical component with the following dimensional characteristics: a tip diameter (K) of between 0.5 mm-0.9 mm, a protrusion length (L) of the noble metal tip beyond the end of the collar section of between 0.1 mm-0.95 mm, a protrusion length (M) of the noble metal tip beyond the end of the insulator of between 1.5 mm-3.5 mm, an axial distance (N) between the end of the copper core 86 and the upper axial end of the noble metal tip of between 2 mm-7 mm, and an overall axial tip length (O) of between 0.5 mm-4 mm. The protrusion distance L may not be uniform about the circumference of the tip as a result of the tip attachment process. In this case, the dimension L represents an average distance from the melt pool of the center electrode material to the axial end (sparking surface) of the tip. It is even more preferable that dimension (K) be between 0.6 mm-0.8 mm, that dimension (L) be between 0.2 mm-0.6 mm, that the dimension (M) be between 2 mm-3 mm, that the dimension (N) be between 3.5 mm-6 mm, and that the dimension (O) be between 1 mm-2.5 mm.

Figure 4:
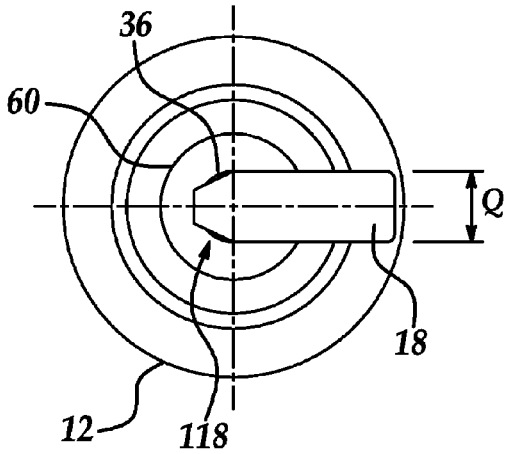
FIG. 4 shows a bottom view of the spark plug of FIG. 1.

The ground electrode 18 is preferably a nickel-based, copper-cored component that is capable of electrically conducting a high voltage ignition pulse, as well as, thermally conducting heat away from the sparking surface. The ground electrode generally includes a first end 110 attached to a lower surface of the shell 12, a side surface 112 that receives noble metal pad 22, a copper or other thermally conducting core 114, and a cladding material 116, which can be a nickel-based material such as Inconel 600/601. As seen in the drawings, the copper core 114 does not extend the entire length of the ground electrode; rather, it preferably stops at a position such that it is not directly beneath the noble metal pad 22. Furthermore, the ground electrode may be of either a circular cross-section, such that there a no longitudinal edges, or a square or rectangular cross section. In either case, it is preferable, although not necessary, that the ground electrode terminate with some type of tapered end 118. This feature is best shown in the bottom view of FIG. 4, where it is seen that the ground electrode is tapered or truncated such that it does not simply terminate at a squared-off blunt end. Of course, the tapered end 118 may also be rounded, pointed, or shaped according to other configurations where the radius or width of the ground electrode 18 diminishes as it approaches the end of the electrode. It is desirable that the ground electrode 18 have the following dimensional characteristics: an electrode thickness (P) in the axial direction of between 0.75 mm-2.25 mm, an electrode width (Q) in the radial direction of between 2 mm-4 mm, and a distance (R) between the end of the copper core and the end of the ground electrode that is between 1 mm-5 mm. It is even more preferable that dimension (P) be between 1 mm-1.75 mm, that dimension (Q) be between 2.25 mm-3.25 mm, and that dimension (R) be between 2 mm-4 mm.

The noble metal pad 22 is attached to the side surface 112 of the ground electrode in the area of the spark gap, such that it prolongs the life of the ground electrode. Preferably, the noble metal pad is made from a platinum or platinum-alloy material, such as platinum-nickel or platinum-tungsten. However, other noble metals, such as iridium, iridium-alloys, etc., may also be used. In the embodiment shown in the drawings, the noble metal pad is a generally flattened cylindrical pad that only rises from the side surface of the ground electrode by a small distance. The upper or exposed surface of the noble metal pad 22 is the sparking surface that forms the spark gap with the lower or exposed surface of the noble metal tip 20. The noble metal pad 22 may be attached to ground electrode 18 by one of several techniques known in the art, including laser and/or resistance welding. As evidenced in FIGS. 3 and 4, it is preferable that the noble metal pad 22 have a larger diameter than that of the noble metal tip 20. It is desirable that the noble metal pad 22 have the following dimensional characteristics: a diameter (S) of between 0.5 mm-2 mm, a protrusion distance (T) above the side surface of the ground electrode of between 0 mm-0.5 mm, and a spark gap (U) that is between 0.5 mm-1.75 mm. It is even more preferable that dimension (S) be between 1 mm-1.5 mm, that dimension (T) be between 0.1 mm-0.3 mm, and that dimension (U) be between 0.75 mm-1.5 mm.

As appreciated by those skilled in the art, the dimensional characteristics of spark plug components, either by themselves or in combination with other components, can affect the performance, durability, and manufacturability of the plug, as well as influencing those applications in which the spark plug assembly may be used, to name but a few of the implications resulting from the choice of dimensions. For example, the outer thread diameter (A) of spark plug shell 12 can impact what types of engines the corresponding spark plug assembly may be used with. In high performance applications space in the cylinder head is limited, thus, a spark plug shell having a 10 mm or 12 mm (M10, M12) diameter may be preferable to those having a 14 mm diameter (M14). Likewise, the interior diameter (E) of the insulator bore and the exterior diameter (H) of the center electrode main shank affect the overall diameter of the spark plug, and hence its potential application in certain engines.

Some dimensions, such as the radial separation (B) between the interior of the shell and the exterior of the insulator, the distance (D) that the nose portion protrudes beyond the shell, and the distance (M) that the noble metal tip portion protrudes beyond the insulator, are capable of affecting the spark flashover and/or carbon fouling properties of the firing end components, and hence the performance and operational life of the spark plug.

Other dimensions, like the axial length (C) of the insulator nose portion and the axial length (F) of the main shank of the center electrode, directly affect the thermodynamics of the spark plug when used in a particular engine design. For example, in an engine which generates a high level of heat rejection to the spark plug, a short nose portion and center electrode main shank will likely be required to guard against spark plug component overheating and concomitant poor endurance or onset of pre-ignition. Whilst in an engine with lower heat rejection, such short components may not be required, or indeed may be detrimental to the anti-cold fouling performance of the spark plug.

Those dimensions pertaining to the length and position of heat conducting cores, such as the center electrode copper-core length (G), the distance (N) between the center electrode copper core and the noble metal tip, and the distance (R) between the ground electrode copper core and the end of the ground electrode, are each capable of influencing the thermal conductivity properties of the spark plug at its firing end. The thermal conductivity of the spark plug firing end components, in turn, can affect the durability and performance of the spark plug, as previously discussed.

Dimensions such as diameter (I) of the first radially reduced portion, diameter (J) of the collar section, diameter (K) of the noble metal tip, protrusion length (L) of the noble metal tip beyond the collar section, and the overall axial length (O) of the noble metal tip are each capable of impacting the process for attaching the noble metal tip to the center electrode. For instance, there are several techniques known in the art for attaching noble metal tips to spark plug electrodes. The dimensions and shape of the noble metal tip, as well as those of the center electrode portion receiving the noble metal tip, can dictate which technique is selected and the specific operating parameters of the selected technique. Other dimensions capable of affecting manufacturing-related considerations include the thickness (P) and the width (Q) of the ground electrode.

The diameter (S) of the noble metal pad and the distance of spark gap (U) are just two examples of dimensions capable of influencing the intensity and nature of the spark created across the spark gap. Thus, selection of these dimensions often times is made with performance related issues in mind. It is worth noting, the dimensions and corresponding affects on performance, durability, manufacturability, and application versatility mentioned above are examples of simply some of the considerations associated with selecting the dimensions of various spark plug components. Other considerations not mentioned herein also exist and play a part in the design of spark plug components, and more particularly, in the selection of spark plug component dimensions. Keeping this in mind, experimentation has found that certain dimensional combinations exhibit advantageous results.

One dimensional combination that has yielded advantageous results is directed to a spark plug having: i) a center electrode main shank portion with a diameter (H) between 1.5 mm-3.5 mm, ii) a center electrode reduced collar section with a diameter (J) between 0.75 mm-1.75 mm, iii) a noble metal tip with a diameter (K) between 0.5 mm-0.9 mm, iv) a noble metal tip with an axial length (O) between 0.5 mm-4 mm, and v) a noble metal tip that extends beyond a collar section by a distance (L) between 0.1 mm-0.95 mm. A spark plug having this dimensional combination has proved to be successful, as it offers an advantageous balance of durability (excellent thermal management of the tip) and ignitability (high protrusion of the fine-wire tip) whilst facilitating low cost manufacture (minimum required volume of noble metal).

Another advantageous dimensional combination is directed to a spark plug having: i) a shell with a thread diameter (A) between 10 mm-14 mm, ii) an insulator nose portion with an axial length (C) between 8 mm-20 mm, iii) an outer nose portion surface spaced from an inner surface of the shell axial bore by a radial distance (B) between 0 mm-3 mm, iv) a nose portion that extends beyond the shell by a distance (D) between 0 mm-6 mm, and v) a noble metal tip that extends beyond the insulator by a distance (M) between 1.5 mm-3.5 mm. This combination also provides improved results, as it successfully reduces the susceptibility of the spark plug to carbon fouling under cold operating conditions and enhances ignitability to yield significant benefits to cold starting performance.

Another combination of dimensions that can be attributed with providing improved results, is directed to a spark plug having: i) a ground electrode with a thickness (P) between 0.75 mm-2.25 mm and ii) a width (Q) between 2 mm-4 mm, a noble metal tip with a diameter (K), and a noble metal pad with a diameter (S) that is greater than diameter (K) and is between 0.5 mm-2 mm. This combination provides a further improvement to spark plug durability through good thermal management of the ground electrode and enhanced local 'wear' protection of the ground electrode, immediately opposite the noble metal chip.

The following dimensional combination is directed to M14 spark plugs; that is, spark plugs have a shell outer thread diameter of 14 mm. This spark plug is utilized in applications where there is enough space in the cylinder head to accommodate spark plug openings of 14 mm, and is directed to a spark plug having: i) a shell with an outer thread diameter (A) of 14 mm, ii) an insulator axial bore with an interior bore diameter (E) of between 2.5 mm-3 mm, iii) a center electrode main shank portion with a diameter (H) between 2.5 mm-3 mm, and a radially reduced center electrode portion with a diameter (I) between 2.25 mm-3 mm. Like the preceding M14 combination, a corresponding M12 combination has also been found. This dimensional combination is directed to a spark plug having: i) a shell with an outer thread diameter (A) of 12 mm, ii) an insulator axial bore with an interior bore diameter (E) of between 2 mm-2.5 mm, iii) a center electrode main shank portion with a diameter (H) between 2 mm-2.5 mm, and a radially reduced center electrode portion with a diameter (I) between 1.75 mm-2.25 mm. Because the M12 plugs have a smaller diameter than the M14 plugs, it follows that certain components must also have a smaller dimension in the radial direction. The dimensional combinations cited above were found to not only accommodate and work well with their respective plug diameters (14 mm or 12 mm), but they also provided improved results in the areas of spark plug performance, durability, and manufacturability.

It will thus be apparent that there has been provided in accordance with this invention a spark plug for use with internal combustion engines which achieves the aims and advantages specified herein. It will, of course, be understood that the forgoing description is of preferred exemplary embodiments of the invention and that the invention is not limited to the specific embodiments shown. Various changes and modification will become apparent to those skilled in the art and all such changes and modifications are intended to be within the scope of this invention.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components or items. Terms of degree such as "about" include not only the specified dimension or other number, but also variations that do not have a substantial impact on the characteristics or application of that to which the number relates. Thus, a spark plug having an outer shell diameter of "about 14 mm" would include spark plugs with shells somewhat less than or greater than 14 mm in diameter, but would not apply to M12-type plugs (12 mm diameters) or other sized spark plugs that are generally used for different applications. Other terms are to be construed using their broadest reasonable meaning unless they are used in a context that requires a different interpretation.

The invention claimed is:

1. A spark plug for use in an internal combustion engine, comprising:

a shell having an axial bore and a thread diameter (A);

an insulator having an axial bore and a nose portion with an axial length (C), said insulator being located within said shell axial bore such that an outer surface of said nose portion is spaced from an inner surface of said shell axial bore by a radial distance (B) and said nose portion extends beyond said shell by a distance (D);

a center electrode being at least partially located within said insulator axial bore and having a main shank portion that includes a lower axial end extending out of said insulator axial bore;

a noble metal tip having a sparking surface, and;

a ground electrode attached to said shell;

wherein said noble metal tip is attached to said lower axial end such that said noble metal tip sparking surface is spaced beyond said insulator by a distance (M) and;

wherein:

10 mm≦A≦14 mm;

8 mm≦C≦20 mm;

0 mm≦B≦3 mm;

0 mm≦D≦6 mm; and 1.5 mm≦M≦3.5 mm.

2. The spark plug of claim 1, wherein said noble metal tip is comprised of Ir or an Ir-alloy.

3. The spark plug of claim 2, wherein said Ir-alloy is an Ir—Rh alloy having Rh in the amount of 1-20%.

4. The spark plug of claim 1, wherein said center electrode includes a metal cladding that is primarily comprised of Ni, Cr and Mn and exhibits a thermal conductivity of approximately 50 W/mK when the material is at a temperature of around 1000° C.

5. The spark plug of claim 1, wherein said noble metal tip has a diameter (K), wherein 0.5 mm≦K≦0.9 mm.

6. The spark plug of claim 1, wherein said noble metal tip has an axial length (O), wherein 0.5 mm≦O≦4 mm.

7. The spark plug of claim 1, wherein said noble metal tip sparking surface and said ground electrode are separated by a spark gap (U), wherein 0.5 mm≦U≦1.75 mm.

8. The spark plug of claim 1, wherein said ground electrode includes a generally flat, noble metal pad for forming a spark gap with said noble metal tip sparking surface.

* * * * *